US005873758A

United States Patent [19]

Mullins

[11] Patent Number: 5,873,758

[45] Date of Patent: Feb. 23, 1999

[54] WATER SKI HANDLE

[76] Inventor: Devan M. Mullins, 400 Capitol Mall, #900, Sacramento, Calif. 95814

[21] Appl. No.: 903,613

[22] Filed: Jul. 31, 1997

[51] Int. Cl.[6] ..... A63C 15/06

[52] U.S. Cl. ..... 441/69

[58] Field of Search ..... 441/69; D21/230

[56] References Cited

U.S. PATENT DOCUMENTS

| | | | |
|---|---|---|---|
| 3,861,347 | 1/1975 | Christenson | 441/69 |
| 4,863,407 | 9/1989 | Casad | 441/69 |
| 4,895,538 | 1/1990 | Marks | 441/69 |
| 5,453,032 | 9/1995 | Crowe | 441/69 |
| 5,503,580 | 4/1996 | McCarthy | 441/69 |

*Primary Examiner*—Jesus D. Sotelo
*Attorney, Agent, or Firm*—Heisler & Associates

[57] ABSTRACT

A water ski handle 10 is provided which exhibits a high level of rigidity and strength such that the water ski handle 10 does not deform significantly even when experiencing high loads during use. The water ski handle 10 includes a rigid frame 20 of generally triangular construction. The frame 20 includes an apex bend 22 to which a ski rope R is attached and a left bend 24 and right bend 26. A base section 30 extends between the left bend 24 and right bend 26 and provides a region for grasping by a hand H of a skier. A left section 34 and right section 37 extend rigidly forward from the base section 30 at opposite ends thereof to the apex bend 22. The frame 20 is constructed with a low density polymeric foam core 60 with longitudinal fibers 70 surrounding the foam core 60 and helical fibers 80 and perpendicular fibers 86 surrounding the longitudinal fibers 70 with all of the fibers 70, 80, 86 embedded within an epoxy resin matrix 90.

22 Claims, 1 Drawing Sheet

WATER SKI HANDLE

FIELD OF THE INVENTION

The following invention relates to handles attachable to water ski ropes for towing a water skier behind a boat or other water craft. More specifically, this invention relates to water ski handles which are light weight and of rigid high strength construction.

BACKGROUND OF THE INVENTION

Water skiing involves a boat or water craft which pulls a skier over the surface of the water. The skier is typically pulled behind the boat by a tow rope with one end attached to the boat and the other end with a handle for the skier to grasp. In recent years, the sport has benefited from the use of a rigid boom which projects from the side of the boat. The skier may ski next to the boat holding on to the boom or with a short length of rope and handle tied to the end of the boom. Using a boom permits the skier to ski on water undisturbed by the boat wake and allows for easier communication between the skier and the boat.

Water skiing generally involves the use of various types of equipment including a water ski or other device which the skier rides across the surface of the water, a personal flotation device, wet suit or ski gloves. In some instances the skier rides across the surface of the water on their feet or body, a sport which is generally known as barefoot water skiing. For most water skiing, the skier uses a tow rope with a handle at the end of the rope. In some instances, skiers release one or both hands from the handle when skiing, most often while performing tricks or maneuvers.

Water ski tow ropes come in a variety of lengths and are made from various materials. The most common ropes are made of a plastic material such as polypropylene, polyethylene or Kevlar. Ropes with less elongation are preferred because they allow the skier better control. One end of the rope usually has a loop for attachment to a secure part of the boat. The other end of the rope typically has a handle which is grasped by the skier. The loads on water ski ropes and handles can be quite significant when used by high performance slalom water skiers, barefoot water skiers, and those engaged in competition.

Typical prior art water ski handles include a single cylindrical linear bar which has a rope passing through the center or with rope attachments at either end, with both ends of the rope tied together before attaching to the remainder of the ski line. The bar is typically a hollow tube of aluminum or similar material. In some cases, the ropes that attach to the handle are covered with some type of flotation device to prevent the handle from sinking in the water and to protect the skier from injury. These rope segments which attach to the handle are generally quite flexible.

Prior art water ski handles suffer from a variety of drawbacks including rope stretch, handle deformation, distortion, breakage, excessive weight and limited flotation. Skiers generally prefer that the ski rope and handle be as inelastic as possible under tension loads and when grasping or releasing the handle during use. Minimizing these drawbacks enhances the skier's ability to perform in an optimal manner. Accordingly, a need exists for a rigid, lightweight ski handle which eliminates the handle ropes, strengthens other portions of the handle and floats.

SUMMARY OF THE INVENTION

This invention provides a water ski handle which is rigid and maintains its form very precisely under a wide range of different loads experienced during towing of a water skier. The ski handle includes a somewhat triangular frame with a base section to which a coating is applied to provide a hand grasping area for the hands of a water skier and a rigid left section and rigid right section extending from ends of the base section up to an apex where the left section and the right section join together. The apex provides a location at which a tow rope can be attached to the handle. A left bend and a right bend are provided on sides of the base section adjacent to the left section and right section respectively. These bends, along with the apex bend, rigidly attach the base section to the left section and the right section. Thus, the entire frame is a single rigid construct.

The frame of the water ski handle is constructed with a cylindrical foam core with fibers surrounding the core and embedded within a matrix of material which can be applied to the fibers in liquid form and then harden into a solid matrix in which the fibers are embedded. The fibers are oriented both longitudinally and helically with respect to the central axis of the cylindrical core to provide strength to the frame sufficient to resist tension, compression, bending and torsional loads on the frame.

OBJECTS OF THE INVENTION

Accordingly, a primary object of the present invention is to provide a water ski handle for a water ski tow rope which rigidly extends from a hand grasping base portion thereof to an apex portion at which the tow rope is connected to the handle.

Another object of the present invention is to provide a water ski handle which does not flex when provided with tension loads similar to those encountered when a water skier is towed by a tow boat.

Another object of the present invention is to provide a water ski handle which is sufficiently light weight to float in water.

Another object of the present invention is to provide a water ski handle which does not include any connectors, but rather is a single unitary mass.

Another object of the present invention is to provide a water ski handle which enhances the ability of a water skier to feel the actions of the tow boat to which a rope of the water ski handle is attached.

Another object of the present invention is to provide a water ski handle which can be readily manufactured from high strength light weight materials to provide the water ski handle with the desired performance characteristics.

Other further objects of the present invention will become apparent from a careful reading of the included description, the claims and included drawing figures.

BRIEF DESCRIPTION OF THE DRAWING FIGURES

DETAILED DESCRIPTION OF THE PREFERRED EMBODIMENT

Figure 1:
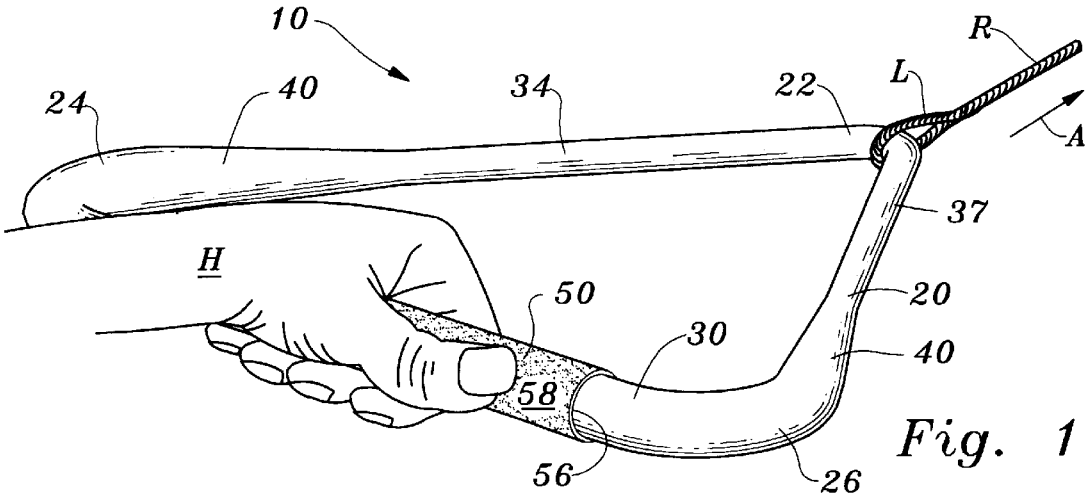
FIG. 1 is a perspective view of the water ski handle of this invention in use connected to a water ski tow rope and grasped by a hand of a water skier.

With reference to the drawings, wherein like reference numerals represent like parts throughout the various different drawing figures, reference numeral 10 is directed to a water ski handle exhibiting high rigidity and light weight construction. The water ski handle 10 is attachable to a rope R which in turn is connectable to a water ski tow boat such that forces are applied along the rope R along arrow A. A coating 50 applied to a frame 20 of the water ski handle is graspable by a hand H of a water skier such that the water skier can be towed by a water ski tow boat through the rope R and water ski handle 10.

In essence, and with particular reference to FIG. 1, the general features of the water ski handle 10 are provided. The water ski handle 10 includes a rigid frame 20 of generally triangular configuration with a coating 50 on a base section 30 of the frame 20. The triangular frame 20 includes a linear left section 34 and linear right section 37 extending from ends of the base section 30 forward to an apex bend 22 where the left section 34 and right section 37 are joined together. A left bend 24 is interposed between the left section 34 and the base section 30 and a right bend 26 is interposed between the right section 37 and the base section 30. Thus, the apex bend 22, left bend 24 and right bend 26 form the three corners of the triangular frame 20 and the base section 30, left section 34 and right section 37 provide the three sides of the triangular frame 20. The base section 30 exhibits a greater diameter than the left section 34 and right section 37 with a transition 40 provided between ends of the base section 30 and the left section 34 and right section 37 to alter the diameter of the frame 20 there between.

The frame 20 is constructed with a solid cylindrical foam core 60 (FIG. 4) which is surrounded by longitudinal fibers 70 extending parallel to a central axis of the foam 60. Helical fibers 80 are wound helically around the longitudinal fibers 70 and around the foam 60. Some of the helical fibers 80 are oriented as perpendicular fibers 86 which wind helically about the longitudinal fibers 70 and foam 60 in an orientation perpendicular to the helical fibers 80. The fibers 70, 80, 86 are all embedded within an epoxy resin matrix 90 securing the fibers 70, 80, 86 to the foam 60. A coating 50 surrounds an outer surface of the base section 30 of the frame 20 and provides a region of enhanced coefficient of friction to allow a skier to more easily grasp the water ski handle 10 with a hand H.

Figure 3:
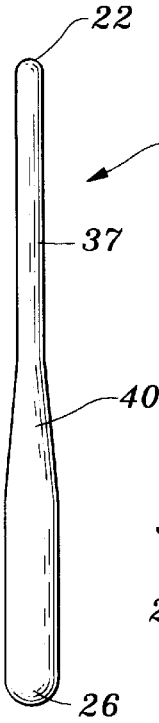
FIG. 3 is a right side view of that which is shown in FIG. 2.
Figure 2:
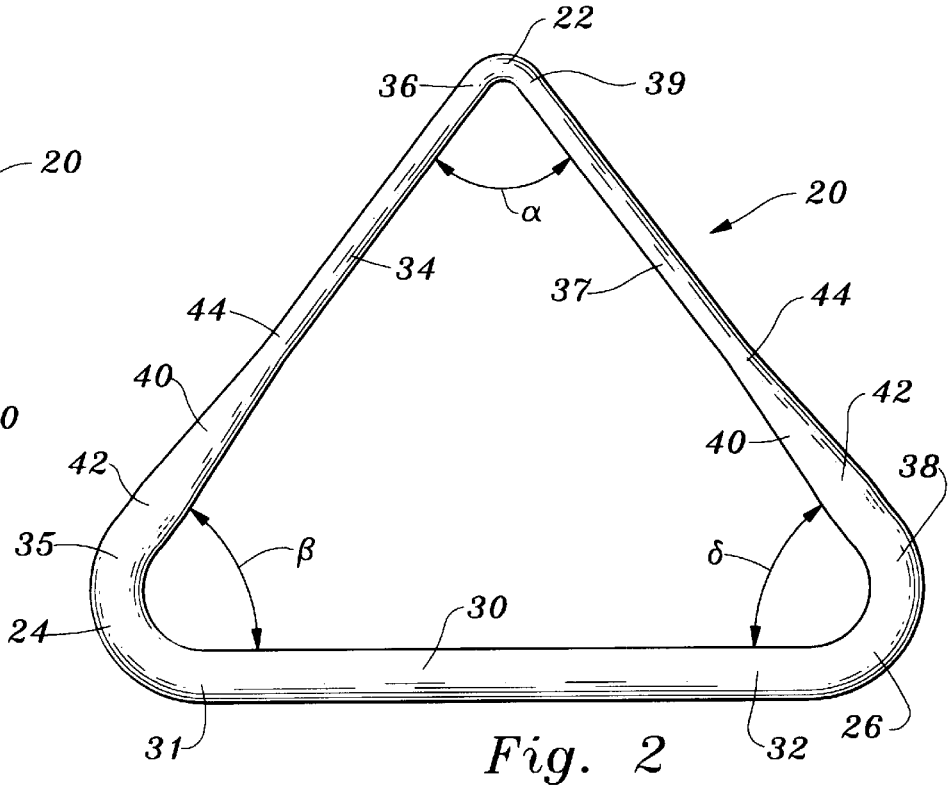
FIG. 2 is a top plan view of a frame portion of the water ski handle of this invention.

More specifically, and with particular reference to FIGS. 2 and 3, details of the frame 20 are provided. The frame 20 is generally triangular when viewed from above and generally circular when viewed in section taken anywhere along the frame 20. The frame 20 is hollow in a middle region thereof such that the frame 20 actually only provides a perimeter of a hollow triangle, rather than a solid. However, within the circular cross-section of the frame 20, as it traces the perimeter of a triangle, the frame 20 is preferably solid and composed of a variety of different structures as discussed below.

The frame 20 thus includes three corners and three sides. The three corners are provided as an apex bend 22, a left bend 24 and a right bend 26. The three sides are provided as the base section 30, the left section 34 and the right section 37. Each of the sections 30, 34, 37 is a cylindrical linear rigid construct. Each of the bends 22, 24, 26 does not provide a sharp corner, but rather is radiused.

The triangular shape of the frame 20 is preferably an isosceles triangle with the base section 30 being slightly longer than the left section 34 and the right section 37. Alternatively, the base section 30 could be shorter than or equal to the length of the left section 34 and the right section 37. The left section 34 and right section 37 are preferably similar in length. Similarly, the apex bend 22 has an angle slightly greater than the left bend 24 and right bend 26. Specifically, an apex angle $\alpha$ preferably has a measure of between 60° and 80°, and optimally 70°. A left bend angle $\beta$ is preferably equal to a right bend angle $\delta$ and measures between 50° and 60°, and optimally 55°. The apex bend 22 is preferably radiused such that an inside of the apex bend has a radius of curvature of 5/16 of an inch when the overall width of the entire frame 20 from the left bend 24 to the right bend 26 measures twelve inches and an overall height of the frame 20 from the base section 30 to the apex bend 22 measures 10¾ inches. Preferably, the left bend 24 and right bend 26 are provided with an inside radius of curvature of one inch. Thus, the apex bend 22 is slightly more sharply radiused than is the left bend 24 and right bend 26.

The base section 30 is a cylindrical linear rigid section extending from a left end 31 to a right end 32. The left end 31 is adjacent the left bend 24 and the right end 32 is adjacent the right bend 26. The left section 34 is cylindrical but includes two different portions including a purely cylindrical portion and a transition 40 which is actually frustoconical and tapered somewhat. The left section 34 includes a rear end 35 adjacent the left bend 24 and a front end 36 adjacent the apex bend 22. The rear end 35 of the left section 34 includes the transition 40 adjacent thereto.

The transition 40 preferably extends for three inches from a large end 42 adjacent the left bend 24 to a narrow end 44 closer to the apex bend 22 than is the large end 42. The remainder of the left section 34 from the transition 40 up to the apex bend 22 preferably has a constant diameter which preferably measures 7/16 of an inch. The large end 42 of the transition 40 preferably has a diameter of ⅞ of an inch. Thus, the transition 40 alters the diameter of the left section 34 from ⅞ of an inch adjacent the large end 42 to 7/16 of an inch adjacent the narrow end 44.

The right section 37 is a mirror image of the left section 34. Thus, the right section 37 includes a back end 38 adjacent the right bend 26 and a forward bend 39 adjacent the apex bend 22. The right section 37 also includes a transition 40 thereon similar to the transition 40 in the left section 34. The base section 30 preferably has a diameter of ⅞ of an inch, with this diameter of the base section 30 remaining constant through both the left bend 24 and right bend 26 and up to the large end 42 of each transition 40.

The apex bend 22 preferably maintains a diameter throughout the apex bend 22 of 7/16 of an inch, such that the frame 20 maintains a constant diameter from the left bend 24 over to the right bend 26, through the apex bend 22. Thus, the cross-sectional diameter of the frame 20 is either ⅞ of an inch or 7/16 of an inch except where the transitions 40 are oriented and the frame 20 transitions from ⅞ of an inch down to 7/16 of an inch.

The larger diameter of the base section 30 makes the base section 30 most easily graspable by most hand sizes. The smaller diameter of the left section 34 and right section 37 provides sufficient structure to maintain the rigidity of the frame 20 but allows non-grasped portions of the frame 20 to exhibit a smaller size and hence a lighter weight. The radii of curvature for the left bend 24 and right bend 26 and the apex bend 22 are provided to be sufficiently gradual to avoid concentration of stresses at the bends 22, 24, 26 and to provide a smooth transition between the various different sections 30, 34, 37 of the frame 20. However, various different radii of curvature could be utilized with slight alterations resulting in performance of the water ski handle 10.

The base section 30 includes the coating 50 thereon. Preferably, the coating 50 is a material which can be applied in a liquid form but then solidify into a solid form upon either drying or receiving a heat or other fixation treatment. The coating 50 preferably only extends along the base section 30 between the left bend 24 and right bend 26, so that the coating 50 is purely a hollow cylindrical layer surrounding a linear central section of the base section 30. The coating 50 includes an inner side 56 adjacent the base section 30 and an outer surface 58 opposite the inner surface 56. The outer surface 58 preferably exhibits a coefficient of friction which is greater than that exhibited by the base section 30 and other portions of the frame 20. Thus, the ability of the water ski handle 10 to be readily grasped by a skier is enhanced adjacent the coating 50.

Figure 4:
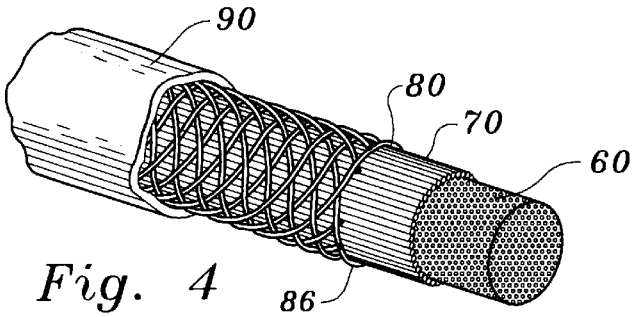
FIG. 4 is a perspective view of a portion of the frame of the water ski handle with different layers included in the construction of the frame peeled away to reveal interior details of the frame of the water ski handle.

With particular reference to FIG. 4, details of the construction of the frame 20 are provided. The frame 20 is preferably of a composite construction with different materials making up different layers within the frame 20. At a center of the frame 20, preferably along all of the various different portions of the frame 20, a cylindrical core 60 is provided. This core is preferably formed from a low density polymeric foam. Thus, the foam 60 adds minimal weight to the water ski handle 10 and provides a cylindrical surface upon which other layers of the water ski handle 10 can be applied during construction. Additionally, the foam 60 resists incursion of water and other liquids into an interior of the frame 20, should a crack or other hole form passing into an interior of the frame 20. The foam 60 thus enhances the buoyancy of the water ski handle 10.

The foam 60 typically is formed from a material which does not have significant rigidity characteristics. Such rigidity is provided by fibers 70, 80, 86 surrounding the foam 60. Preferably, the fibers 70, 80, 86 are oriented in three distinct orientations. The first orientation provides longitudinal fibers 70 extending parallel to a long axis of the cylindrical foam core 60 in an orientation such that each longitudinal fiber 70 is adjacent other longitudinal fibers 70 so that the longitudinal fibers 70 entirely surround the foam core 60.

The fibers 70, 80, 86 are generally selected from a material which has little or no elasticity when loaded in tension along a length of the fibers 70, 80, 86. For instance, if the fibers are formed from carbon or carbon composite materials such that the fibers 70, 80, 86 are carbon fibers, the longitudinal fibers 70 will exhibit essentially no elongation when loaded along a length of the frame 20 parallel to the long axis thereof. Another material having desirable rigidity and density for the frame 20 is Kevlar.

However, the longitudinal fibers 70 do not provide torsional load deformation resistance or significant bending load resistance. Hence, helical fibers 80 are provided wrapping helically around the longitudinal fibers 70 and the foam core 60. Preferably, the helical fibers 80 are paired up with perpendicular fibers 86 which also wrap helically about the longitudinal fibers 70 and foam core 60 but in an orientation perpendicular to the helical fibers 80. The helical fibers 80, 86 provide enhanced strength to the frame 20 to resist bending and torsional loads experienced thereby. However, the helical fibers 80 and perpendicular fibers 86 do not significantly resist tension loads along a central axis of the cylindrical foam 60. Thus, the helical fibers 80 and perpendicular fibers 86 benefit from the presence of the longitudinal fibers 70 and their resistance to longitudinal deformation. Considered together, the fibers 70, 80, 86 provide high rigidity and resistance to longitudinal, torsional and bending loads which the frame 20 might experience.

To prevent motion of the fibers 70, 80, 86 relative to each other and to prevent damage to individual fibers, the fibers 70, 80, 86 are embedded within an epoxy resin matrix 90. Such a matrix is generally a material which exhibits two different phases including a liquid phase during a formation stage which can then harden into a solid phase when desired. Preferably, the resin is in liquid form when it is embedded into the area between the fibers 70, 80, 86 by techniques such as pressurizing the liquid resin when it is applied to the fibers 70, 80, 86. The resin 90 is then allowed to harden into position, encasing the fibers 70, 80, 86 and the foam 60 within the resin.

While preferably the foam core 60 extends entirely around the triangular frame 20, alternatively, the foam core 60 can be provided merely along the base section 30. In such a configuration, other portions of the frame 20 can be allowed to remain hollow or can be merely filled with the epoxy resin matrix during the manufacturing procedure.

The fibers 70, 80, 86 can either be wound individually around the foam core 60 or can be provided as a fabric having the desired weave pattern to provide longitudinal fibers 70, helical fibers 80 and perpendicular fibers 86. Such fabrics could either be provided with separate layers or as a single fabric with all of the separate layers included therein. For instance, one layer could be provided which includes longitudinal fibers embedded within a matrix and perpendicular fibers embedded within a matrix. The longitudinal fabric would then be wrapped around the foam core 60 in a manner providing the longitudinal fibers 70 in the desired orientation. The helical fibers 80 and perpendicular fibers 86 would then be wrapped around the longitudinal fibers 70 by placing the fabric having the helical fibers 80 and perpendicular fibers 86 overlying the fabric including the longitudinal fibers 70 with the helical fibers 80 and perpendicular fibers 86 in the desired orientation.

If desired, multiple layers of longitudinal fibers 70 and helical fibers 80 can be provided in either alternating layers or in consecutive layers. Similarly, the fibers 70, 80, 86 can all be woven together in an integrated fashion. In general, as additional layers of fibers 70, 80, 86 are provided, an overall strength of the frame 20 and hence the water ski handle 10 is enhanced, as well as a rigidity of the water ski handle 10.

After the epoxy resin matrix 90 has become fixed in solid form, the coating 50 is preferably applied to the base section 30 of the frame 20 to complete the water ski handle 10. The water ski rope R can then be attached to the water ski handle 10 adjacent the apex bend 22 by providing a loop L in the rope R or some knot or other feature in the rope R to wrap around the apex bend 22. The water ski handle 10 can then be utilized in the same manner as prior art water ski handles, except that the water ski handle 10 exhibits a high level of rigidity and light weight characteristics for high performance operation.

Moreover, having thus described the invention it should be apparent that various different modifications could be made to the invention without significantly altering the characteristics exhibited thereby. For instance, while carbon fiber has been indicated as a preferred material for formation of the water ski handle 10, various different materials including fiberglass or plastics or other composite materials could similarly be utilized and still benefit from many of the features disclosed herein. While the preferred angles and radiuses and diameters of the triangular frame 20 have been specifically identified, different adjustments could be made thereto to accommodate skiers having different hand H sizes, strengths or desires for the performance of the handle 10, resulting in the alteration of these dimensions somewhat.

It is also understood that while the frame 20 is shown to have a generally triangular configuration, the frame 20 need only have the base section 30 provided in an orientation generally perpendicular to that of a region of the frame 20 to which the rope R is attached. Thus, the frame 20 could for instance be pentagonal and still provide an apex bend directly opposite a base section to which a handle grasping area could be provided. Also, lengths of various different sections 30, 34, 37 of the water ski handle 10 could be increased or decreased if desired. While it is preferred that the water ski handle 10 be a closed loop for maximum rigidity, it could also be possible that the apex bend 22 could be removed and the left section 34 and the right section 37 could extend rigidly forward and then transition into the tow rope R by providing various different connectors to both the left section 34 and right section 37, provided that the right section 37 and left section 34 rigidly connect to the base section 30 and extend forward from the left end 31 and right end 32 of the base section 30.

What is claimed is:

1. A water ski handle for attachment to a water skiing tow rope, the handle comprising in combination:

a rigid cylindrical base section extending linearly between a left end and a right end;

a left bend rigidly formed with said base section and bending forward away from a central axis of said base section;

a right bend rigidly formed with said base section and bending forward away from said central axis of said base section;

said left bend and said right bend including means to attach to the water skiing tow rope;

wherein said left bend extends rigidly forward as an elongate left section and said right bend extends rigidly forward as an elongate right section, said left section and said right section each supporting said means to attach to the rope;

said left section and said right section formed from a rigid material;

wherein said left section includes a front end opposite said left bend and said right section includes a forward end opposite said right bend, said front end of said left section rigidly attached to said forward end of said right section at an apex, said apex including said means to attach to the rope;

wherein said left section and said right section extend linearly from said base section to said apex, said left section and said right section each having a circular cross-section; and wherein said means to attach to the rope provided by said apex includes the rope being looped around said apex such that at least a portion of the rope passes between said apex and said base section, between said left section and said right section.

2. The water ski handle of claim 1 wherein said left section and said right section are of equal length and wherein said left section, said right section and said base section together form a triangle.

3. The water ski handle of claim 2 wherein said base section has a diameter which is greater than a diameter of said left section and said right section and wherein said left section and said right section have substantially equal diameters.

4. The water ski handle of claim 3 wherein said left section extends away from said left bend at an angle to said base section which matches an angle between said base section and said right section as said right section extends away from said right bend, such that said triangle formed by said left section, said right section and said base section is an isosceles triangle.

5. A water ski handle for attachment to a water skiing tow rope, the handle comprising in combination:

a rigid cylindrical base section extending linearly between a left end and a right end;

a left bend rigidly formed with said base section and bending forward away from a central axis of said base section;

a right bend rigidly formed with said base section and bending forward away from said central axis of said base section;

said left bend and said right bend including means to attach to the water skiing tow rope;

wherein said rigid cylindrical base section said left bend and said right bend are each formed from materials including a plurality of substantially inextensible elongate fibers;

wherein at least one of said elongate fibers is a parallel fiber oriented substantially parallel to said central axis of said base section and at least one of said fibers is a helical fiber oriented in a position revolving helically around said central axis of said base section; and wherein at least one of said fibers is a counter fiber oriented in a position revolving helically around said central axis of said base section in a direction counter to a direction of helical rotation of at least one of said helical fibers forming said water ski handle.

6. The water ski handle of claim 5 wherein at least a portion of said fibers forming said base section and said left bend and said right bend are carbon fibers and wherein at least a portion of said fibers forming said base section are made of Kevlar;

wherein a surface of said base section includes a coating thereon, said coating formed from a material having a greater coefficient of friction than a coefficient of friction exhibited by other portions of said base section, such that an ability of a user to grip said base section through said coating is enhanced; and wherein said fibers of said base section are wrapped around an exterior of a foam core, said foam core having a density sufficiently less than a density of water that said water ski handle floats when located in water.

7. A rigid water skiing tow rope handle, comprising in combination:

a rigid cylindrical base section extending linearly between a left end and a right end;

a left bend rigidly formed with said base section and bending forward away from a central axis of said base section;

a right bend rigidly formed with said base section and bending forward away from said central axis of said base section;

a rigid left section rigidly attached to said left bend and extending forward to an apex;

a rigid right section rigidly attached to said right bend and extending forward to said apex;

said apex rigidly joining said left section and said right section together;

said handle including a plurality of elongate substantially inextensible fibers; and wherein at least one of said elongate fibers is a longitudinal fiber, said longitudinal fiber oriented parallel to said central axis of said base section, said elongate fibers including at least one helical fiber extending helically around said central axis of said base section, said elongate fibers including at least one counter rotating fiber, said counter rotating fiber oriented helically around said central axis of said base section in a direction counter to a direction of rotation of said helical fiber around said central axis of said base section.

8. The tow rope handle of claim 7 wherein said left section and said right section extend linearly between said base section and said apex, said left section and said right section having a circular cross-section, said left section and said right section integrally formed with each other and with said base section, said left section and said right section including said longitudinal fibers, said helical fibers and said counter fibers.

9. The tow rope handle of claim 7 wherein said elongate fibers are supported within a solid matrix, said matrix fixing said elongate fibers in a constant orientation relative to said base section, said left section and said right section.

10. The tow rope handle of claim 9 wherein said elongate fibers are formed from materials taken from the group of materials including carbon fibers and Kevlar fibers; and wherein said matrix includes a liquid resin which hardens into a solid material.

11. The tow rope handle of claim 9 wherein said base section includes a cylindrical foam core aligned with said central axis of said base section, said elongate fibers located beyond an exterior surface of said cylindrical foam core, said foam core having a density less than a density of water.

12. The tow rope handle of claim 11 wherein said foam core is sealed to preclude water from being absorbed therein and said tow rope handle has an overall density less than a density of water, such that said tow rope handle floats when placed in water.

13. The tow rope handle of claim 10 wherein said base section includes a coating on an outermost surface of said base section, said coating formed from a material having a coefficient of friction which is greater than a coefficient of friction of materials forming portions of said base section adjacent said coating.

14. A method for forming a water skiing tow rope handle, including the steps of:

providing a cylindrical elongate piece of solid foam;

applying elongate substantially inextensible fibers to an outer surface of the foam cylinder;

extending elongate substantially inextensible fibers away from both ends of the foam cylinder to an apex forward of the foam cylinder;

applying a liquid resin matrix to the elongate fibers;

allowing the liquid resin matrix to harden into a solid; and attaching a tow rope to the apex.

15. The method of claim 14 including the further steps of:

selecting the elongate fibers to be formed from materials taken from a group of materials including carbon fibers and Kevlar fibers;

pressurizing the liquid resin matrix after the liquid resin matrix is applied to the elongate fibers and before hardening of the liquid resin matrix;

shaping the elongate fibers to extend linearly as a left section and a right section away from the ends of the foam core and toward the apex; and orienting some of the elongate fibers to wrap helically around a central axis of the foam core and orienting some of the elongate fibers to extend longitudinally parallel to the central axis of the foam core.

16. A water ski handle for attachment to a water skiing tow rope, the handle comprising in combination:

an elongate base section extending substantially linearly between a left end and a right end;

an elongate left section attached to said left end of said base;

an elongate right section attached to said right end of said base;

an apex joining said left section to said right section such that said base section, said left section and said right section together form a continuous loop; and said continuous loop being rigid.

17. The handle of claim 16 wherein said rope is attached to said apex by being looped around said apex such that at least a portion of said rope passes between said apex and said base section at a location surrounded by said continuous loop.

18. The handle of claim 16 wherein said handle has a lower density than water, such that said handle floats in water.

19. The handle of claim 16 wherein said apex is V-shaped with said elongate left section forming one leg of said V and said elongate right section forming the other leg of said V.

20. The handle of claim 19 wherein said V of said apex has an internal angle measuring less than 90°.

21. The handle of claim 16 wherein a core within said base section, said left section and said right section is solid.

22. The handle of claim 16 wherein a core of said base section, said left section and said right section is ropeless.

* * * * *